US006401682B1

(12) United States Patent
Nozue

(10) Patent No.: US 6,401,682 B1
(45) Date of Patent: Jun. 11, 2002

(54) LUBRICATION SYSTEM FOR OUTBOARD MOTOR ENGINE

(75) Inventor: Toshihiro Nozue, Shizuoka (JP)

(73) Assignee: Sanshin Kogyo Kabushiki Kaisha, Shizuoka (JP)

( * ) Notice: Subject to any disclaimer, the term of this patent is extended or adjusted under 35 U.S.C. 154(b) by 0 days.

(21) Appl. No.: 09/664,513

(22) Filed: Sep. 18, 2000

(30) Foreign Application Priority Data

Sep. 16, 1999 (JP) ..... 11-262482

(51) Int. Cl.[7] ..... F01M 11/00

(52) U.S. Cl. ..... 123/196 W; 123/195 P; 123/198 C

(58) Field of Search ..... 123/196 W, 195 P, 123/198 C; 440/88

(56) References Cited

U.S. PATENT DOCUMENTS

| | | | | |
|---|---|---|---|---|
| 5,074,812 A | | 12/1991 | Watanabe | 440/52 |
| 5,085,187 A | * | 2/1992 | Black | 123/196 R |
| 5,704,819 A | * | 1/1998 | Isogawa | 440/88 |
| 5,876,188 A | | 3/1999 | Okamoto | 417/364 |
| 6,041,892 A | * | 3/2000 | Watanabe et al. | 184/6.28 |
| 6,076,495 A | * | 6/2000 | Takahashi et al. | 123/196 W |
| 6,192,853 B1 | * | 2/2001 | Natsume | 123/196 W |

FOREIGN PATENT DOCUMENTS

| | | |
|---|---|---|
| JP | 4-295114 | 10/1992 |
| JP | 5-33779 | 2/1993 |

* cited by examiner

*Primary Examiner*—Tony M. Argenbright
*Assistant Examiner*—Hai Huynh
(74) *Attorney, Agent, or Firm*—Knobbe, Martens, Olson & Bear LLP

(57) ABSTRACT

A lubrication system for an outboard motor engine includes a pump housing includes an inlet port through which lubricant enters the pump housing and an outlet port through which the lubricant is discharged from the pump housing. Both the crankshaft and the driveshaft extend through an opening defined at the pump housing and are couple with each other within the pump housing. A first seal member is disposed around the crankshaft for sealing a first location between an outer surface of the crankshaft and a first inner surface of the pump housing that defines at least a portion of the opening. A second seal member is disposed around the driveshaft for sealing a second location between an outer surface of the driveshaft and a second inner surface of the pump housing that also defines at least a portion of the opening.

21 Claims, 7 Drawing Sheets

LUBRICATION SYSTEM FOR OUTBOARD MOTOR ENGINE

PRIORITY INFORMATION

This invention is based on and claims priority to Japanese Patent Application No. Hei 11-262482, filed Sep. 16, 1999, the entire contents of which is hereby expressly incorporated by reference.

BACKGROUND OF THE INVENTION

1. Field of the Invention

This invention relates to a lubrication system for an outboard motor engine, and more particularly to a sealing construction for a pump housing of a lubrication system for an outboard motor engine.

2. Description of Related Art

A typical outboard motor includes a drive unit and a bracket assembly. The bracket assembly is mounted on a transom of an associated watercraft and supports the drive unit. The drive unit carries a propulsion device, such as a propeller, which is normally placed in a submerged position. The propulsion device has a propulsion shaft. An internal combustion engine is employed for powering the propulsion device. The engine has a crankshaft. Because the engine is normally positioned atop the drive unit, a driveshaft extends between the crankshaft of the engine and the propulsion shaft so as to transmit engine output to the propulsion device.

The driveshaft is coupled with the bottom end of the crankshaft. A spline connection is usually applied to couple together the shafts. A lubrication system for the engine usually has an oil pump unit defined at this connection so that the crankshaft can drive the oil pump.

The outboard motor is surrounded by a body of water when used, and quite often uses the water for cooling the engine and an exhaust system. The shaft connection is exposed to the water. If the outboard motor is used at the sea, the water contains impurities such as salt. The impurities deposit on the connection between the driveshaft and the crankshaft and/or corrodes the connection, thereby causing the shafts to stick together, which makes it difficult to disassemble the shafts.

In order to avoid this situation from occurring, lubricant oil of the lubrication system can be used because the oil exists in the close proximity to the coupling portion. The lubrication system, however, has only a limited amount of oil due to a relatively small space the outboard motor. The oil for the lubrication system thus should not be applied for that purpose. If applied, however, the oil at the coupling portion must be removed when the entire oil is replaced. Otherwise, the oil that accumulates there will deteriorate.

Japanese Laid Open Patent Publication H04-295114 discloses a solution for the problem. A rotary oil pump is defined around a coupling portion of a crankshaft with a driveshaft. The oil pump includes a pump plate, a pump case depending from the pump plate and a seal housing. These three components substantially define a pump cavity that contains rotors driven by the crankshaft. The coupling portion between the shafts includes a sleeve which is press-fitted into a recess formed at the bottom of the crankshaft. The sleeve is internally splined. The driveshaft also is splined at its top end and is coupled with the sleeve. One seal member is provided between an inner surface of the seal housing and an outer surface of the sleeve. Another seal member is provided between an inner surface of the seal housing and an outer surface of the sleeve.

In this construction, however, the outer surface of the sleeve must be machined after being press-fitted into the recess for ensuring a sufficient seal. Manufacturing steps thus increase. In other words, manufacturing of the outboard motor becomes more costly.

A need therefore exists for an improved lubrication system that can inhibit water from entering a coupling portion of the crankshaft with the driveshaft and can use oil from a lubrication system without increasing the number of manufacturing steps.

SUMMARY OF THE INVENTION

In accordance with one aspect of the present invention, a lubrication system is provided for an internal combustion engine. The engine has a crankshaft extending generally vertically. A driveshaft also extends generally vertically and is driven by the crankshaft. The lubrication system comprises a pumping assembly driven by the crankshaft. A pump housing is arranged to contain the pumping assembly. The pump housing includes an inlet port through which lubricant enters the pump housing and an outlet port through which the lubricant is discharged from the pump housing. Both the crankshaft and the driveshaft extend through an opening defined at the pump housing and are coupled with each other within the pump housing. A first seal member is disposed around the crankshaft to seal a first location between an outer surface section of the crankshaft and a first inner surface section of the pump housing that defines at least a portion of the opening. A second seal member is disposed around the driveshaft for sealing a second location between an outer surface of the driveshaft and a second inner surface section of the pump housing that also defines at least a portion of the opening.

In accordance with another aspect of the present invention, an oil pump unit is provided for an outboard motor. The outboard motor has a driveshaft extending generally vertically and an internal combustion engine including an output shaft extending generally vertically. The oil pump unit comprises an upper housing section. A lower housing section is coupled with the upper housing section and defines, together with the upper housing section, an internal cavity adapted to contain lubricant. The driveshaft and the output shaft included engaged end portions that are coupled with each other in the internal cavity. A pumping assembly is disposed within the internal cavity and is driven by the output shaft. A first seal member is positioned between the output shaft and the upper housing member to inhibit the lubricant oil from leaking out of the internal cavity. A second seal member is positioned between the output shaft and the lower housing section to inhibit the lubricant oil from entering a location about the engaged end portions of the driveshaft and output shaft within the internal cavity. A third seal member is positioned between the driveshaft and the lower housing section to inhibit water from entering the location about the engaged end portions.

Further aspects, features and advantages of this invention will become apparent from the detailed description of the preferred embodiment which follows.

BRIEF DESCRIPTION OF THE DRAWINGS

These and other features of this invention will now be described with reference to the drawings of a preferred embodiment which is intended to illustrate and not to limit the invention. The drawings contain the following figures.

DETAILED DESCRIPTION OF THE PREFERRED EMBODIMENT OF THE INVENTION

Figure 1:
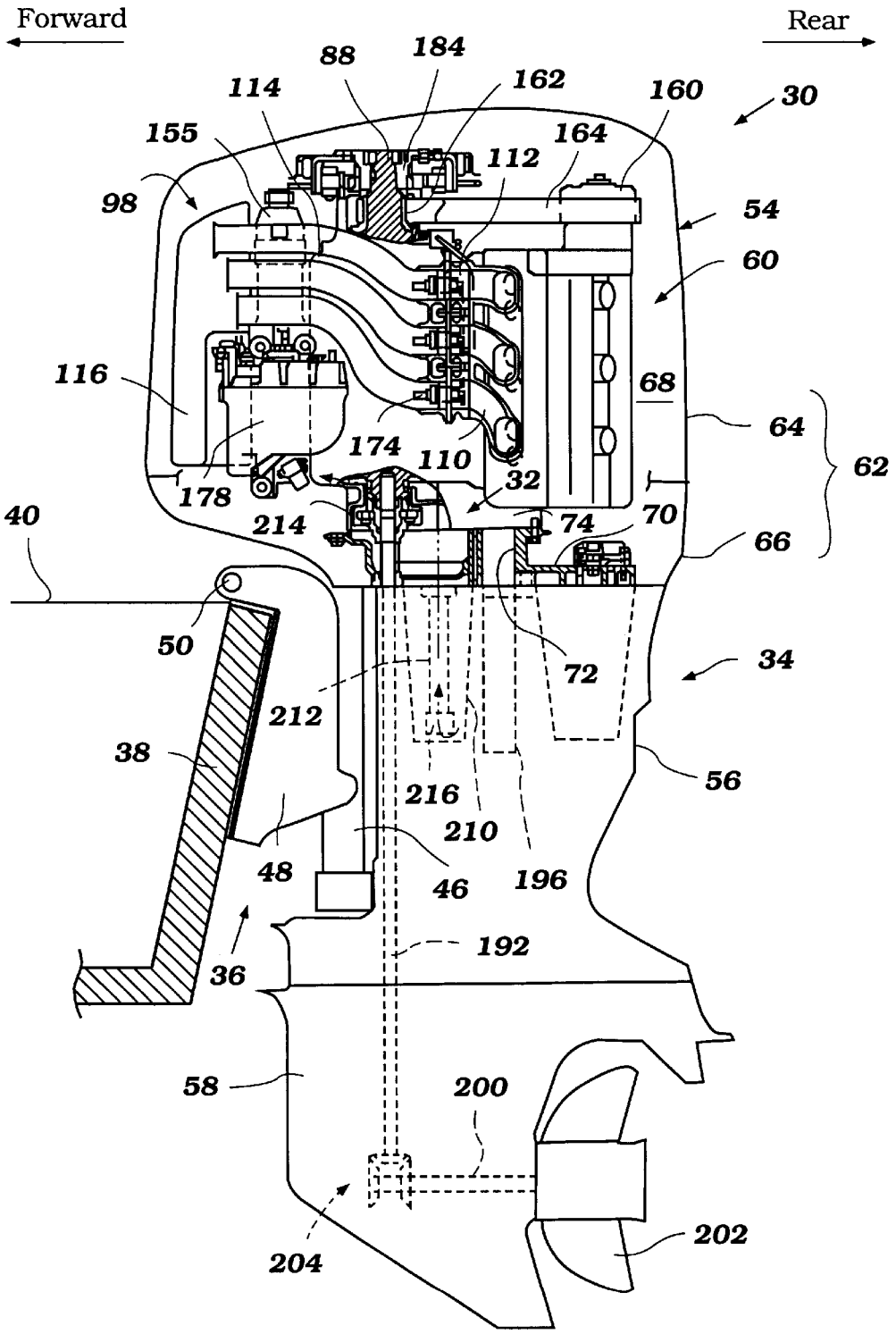
FIG. 1 is a side elevational view of an outboard motor employing a lubrication system arranged in accordance with a preferred embodiment of the present invention. An associated watercraft is partially shown in section.

With primary reference to FIG. 1 and additionally to FIGS. 2 to 5, an outboard motor 30 employs a lubrication system 32 arranged in accordance with a preferred embodiment of the present invention. While the present lubrication system and engine construction are described in the context of an outboard motor, it is understood that the invention can be practiced with engines used in other types of products.

In the illustrated embodiment, the outboard motor 30 comprises a drive unit 34 and a bracket assembly 36. The bracket assembly 36 supports the drive unit 34 on a transom 38 of an associated watercraft 40 so as to place a marine propulsion device in a submerged position with the watercraft 40 resting on the surface of a body of water. The bracket assembly 36 comprises a swivel bracket 46, a clamping bracket 48, a steering shaft and a pivot pin 50.

The steering shaft extends through the swivel bracket 46 and is affixed to the drive unit 34 with an upper mount assembly and a lower mount assembly. The steering shaft is pivotally journaled for steering movement about a generally vertically extending steering axis within the swivel bracket 46. A steering handle extends upwardly and forwardly from the steering shaft to steer the drive unit 34. The clamping bracket 48 includes a pair of bracket arms spaced apart from each other and affixed to the transom 38 of the associated watercraft 40. The pivot pin 50 completes a hinge coupling between the swivel bracket 46 and the clamping bracket 48. The pivot pin 50 extends through the bracket arms so that the clamping bracket 48 supports the swivel bracket 46 for pivotal movement about a generally horizontally extending tilt axis of the pivot pin 50. Although not shown, a hydraulic tilt and trim adjustment system is provided between the swivel bracket 46 and the clamping bracket 48 to tilt up and down and also for the trim adjustment of the drive unit 34.

As used through this description, the terms "fore," "front," "forward" and "forwardly" mean at or to the side where the clamping bracket 48 is located, and the terms "aft," "rear," "reverse" and "rearwardly" mean at or to the opposite side of the front side, unless indicated otherwise or otherwise readily apparent from the context of use.

The drive unit 34 includes a power head 54, a driveshaft housing 56 and a lower unit 58. The power head 54 is disposed atop the drive unit 34 and includes an internal combustion engine 60 and a protective cowling assembly 62. The protective cowling assembly 62 includes a top cowling member 64 and a bottom cowling member 66.

The protective cowling assembly 60 generally completely surrounds the engine 32 so as to enclose it in a closed cavity 68. The top cowling member 64 is detachably affixed to the bottom cowling member 66 with a conventional coupling mechanism so that the operator can access the engine 60 for maintenance or for other purposes.

As is well known, the top cowling member 64 has an air intake port disposed on its rear and top portion. A pair of air intake ducts is provided at a position adjacent to the intake port so that ambient air enters the closed cavity 68 through the port and the intake ducts. The top cowling member 64 narrows in width toward its upper end.

The bottom cowling member 66 has an opening at its bottom portion through which an upper portion of an exhaust guide member 70 extends. The exhaust guide member 70 is affixed atop the driveshaft housing 56. The bottom cowling member 66 and the exhaust guide member 70, thus, generally form a tray. The engine 60 is placed onto this tray and is affixed to the exhaust guide member 70 so as to be supported thereby. The exhaust guide member 70 also has an exhaust passage 72 through which burnt charges (e.g., exhaust gases) from the engine 60 are discharged as described below.

Figure 3:
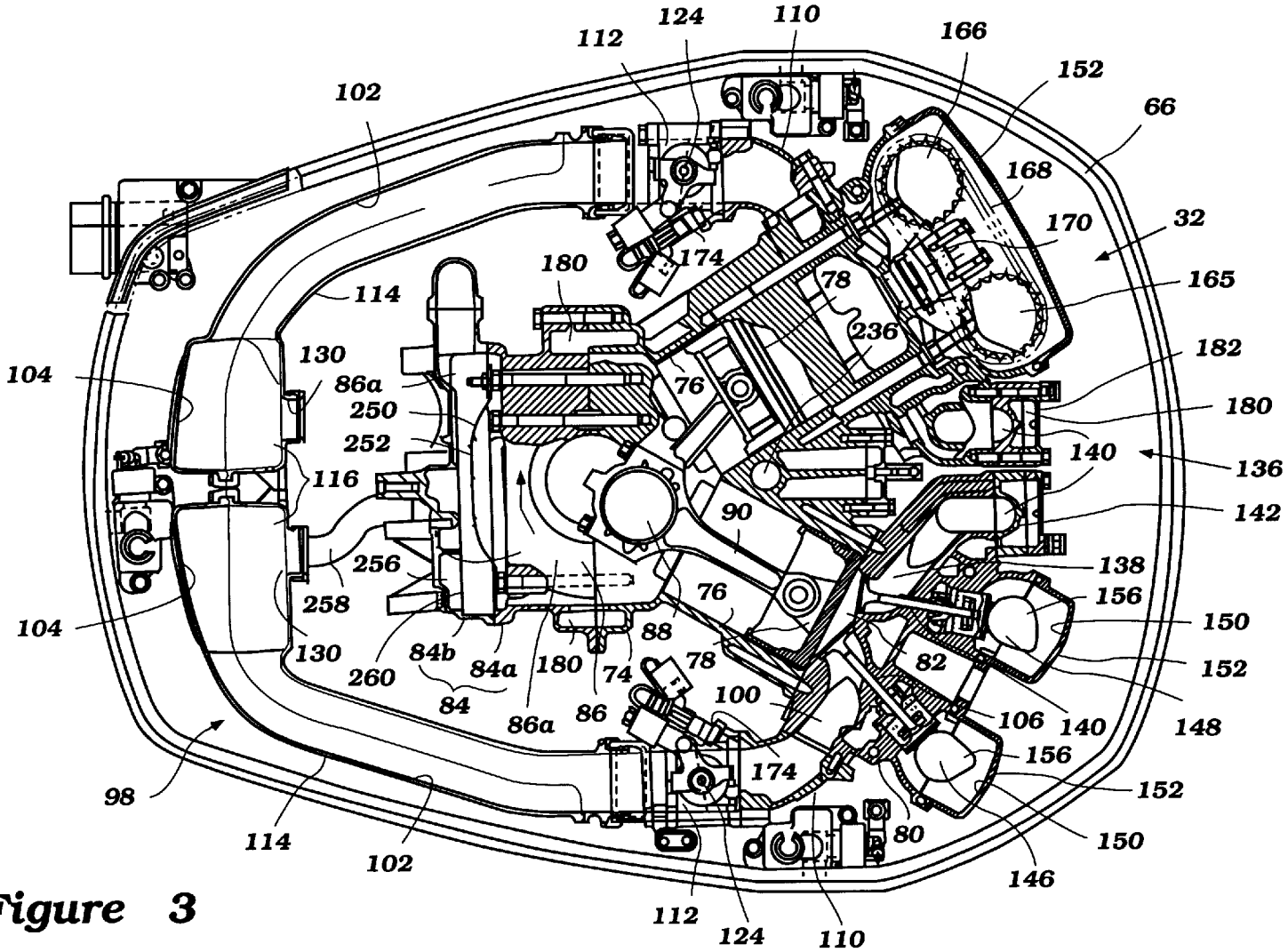
FIG. 3 is a top plan view of the power head shown in a manner similar to FIG. 2 except that the engine and its air induction system are illustrated in section. An oil filter also is omitted.

The engine 60 in the illustrated embodiment operates on a four-cycle combustion principle and powers a propulsion device. The engine 60 has a cylinder body 74. The cylinder body 74 defines six cylinder bores 76. The cylinder body 74 is generally configured as a V-shape to form two banks so that adjacent cylinder bores 76 are spaced apart horizontally from each other in a plan view as seen in FIG. 3, although they are slightly off-set vertically. Each bank of the cylinder body 74 includes three cylinder bores 76 that extend generally horizontally and are spaced apart vertically from each other. That is, the engine 60 is a horizontal cylinder, V6 type. This type of engine, however, merely exemplifies one engine type on which various aspects and features of the present invention can be used. The present lubrication system can be with engines having other number of cylinders, having other cylinder arrangements, and operating on other combustion principles.

As seen in FIG. 3, a piston 78 reciprocates in each cylinder bore 76. A pair of cylinder head members 80 is affixed to the ends of the cylinder banks of the cylinder body 74 for closing the cylinder bores 76 of the respective banks. The cylinder head members 80 define six combustion chambers 82 with the pistons 78 and the cylinder bores 76. Each bank has three combustion chambers 82.

A crankcase assembly 84 closes the other ends of the cylinder bores 76 and defines a crankcase chamber 86 with the cylinder body 74. In the illustrated embodiment, the crankcase assembly 84 comprises two pieces, i.e., a crankcase member 84*a* and a crankcase cover 84*b*. The crankcase cover 84*b* is affixed to the crankcase member 84*a*. The crankcase assembly 84, however, can be formed with a single piece.

A crankshaft 88 extends generally vertically through the crankcase chamber 86.

Figure 4:
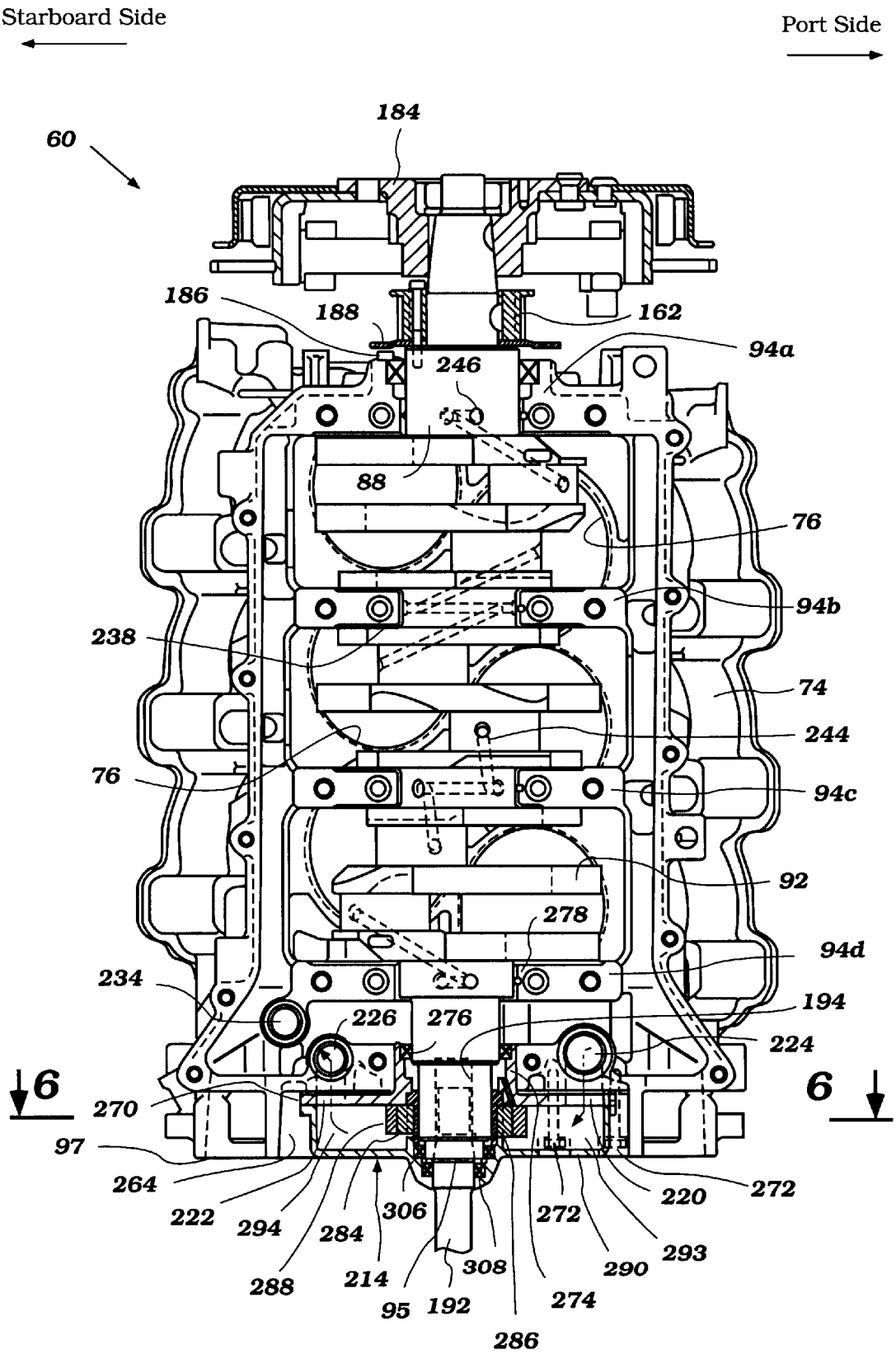
FIG. 4 is a front view of the engine without a crankcase assembly. An oil pump unit is sectioned.

The crankshaft 88 is rotatably coupled with the pistons 78 by respective connecting rods 90 and thus rotates with the reciprocal movement of the pistons 78. The crankshaft 88 has counter weights 92 opposite to the pistons 78 to effectively balance the rotation of the crankshaft. The crankshaft 88 is journaled by bearing blocks which are formed by end portions of the cylinder body 74 and the crankcase member 84*a*. As best seen in FIG. 4, the bearing blocks comprise an top bearing portion 94*a*, intermediate bearing portions 94*b*, 94*c* and a bottom bearing portion 94*d*.

The crankcase assembly 84 is located at the most forward position, then the cylinder body 74 and the cylinder head member 80 extend rearwardly from the crankcase assembly 84 one after another. At least these major engine components 74, 80, 84 are preferably made of aluminum alloy.

Figure 5:
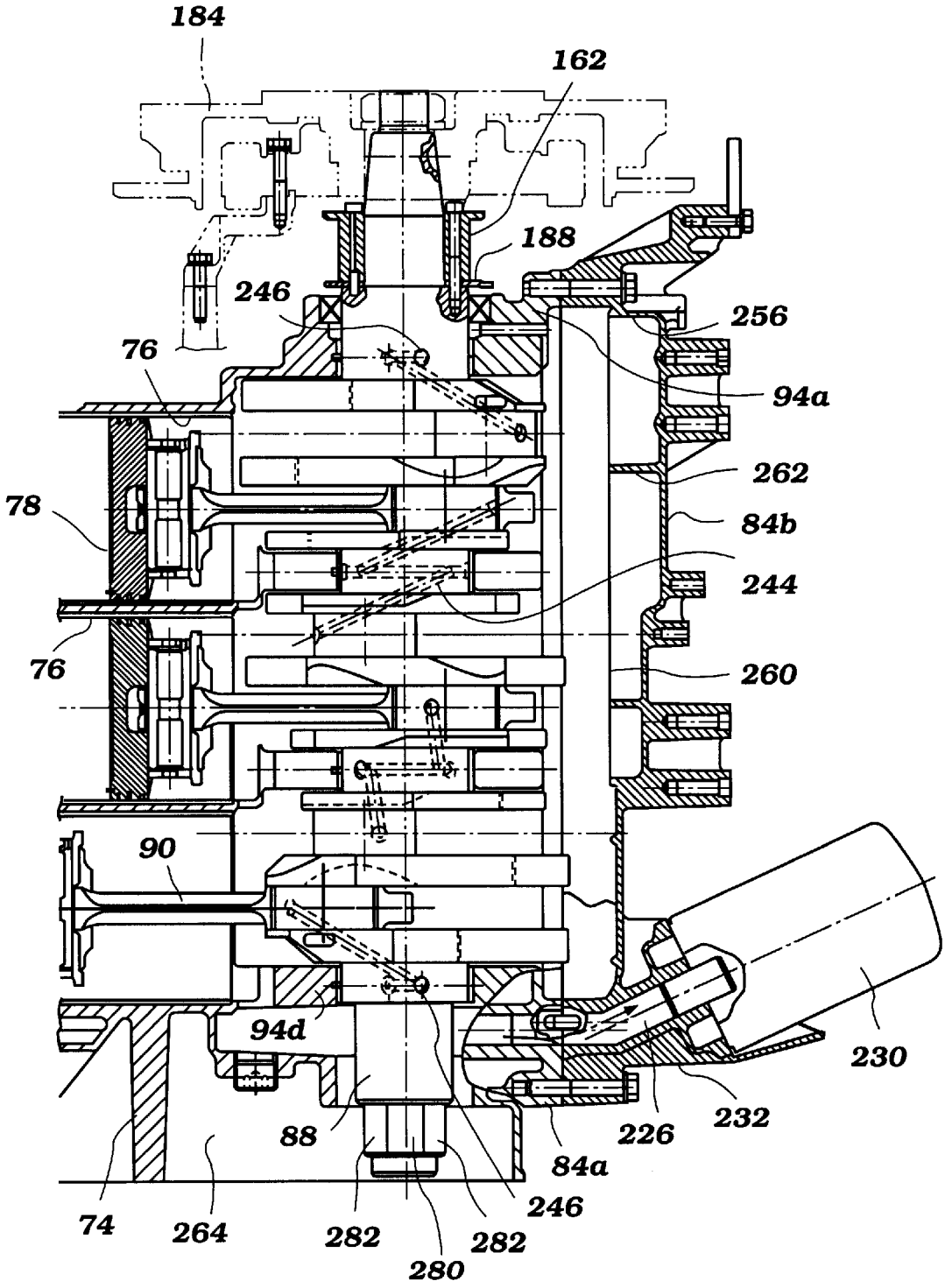
FIG. 5 is a cross-sectional side view of a portion of the engine generally taken along a vertical plane including a center line, extending through a cylinder body, a crankcase member and a crankcase cover. The oil pump unit and a baffle plate are omitted.

In the illustrated embodiment, as seen in FIGS. 4 and 5, the bottom end 95 of the crankshaft 88 is positioned higher than the bottom end 97 of the cylinder body 74 and the crankcase assembly 84. This is advantageous for storage of the engine 60. That is, the assembled engine can rest on its bottom end without damaging the lower end of the crankshaft. This is important when storing the engine before it is assembled into the outboard motor (or other product) or when the engine is removed from the outboard motor (or other product).

Figure 2:
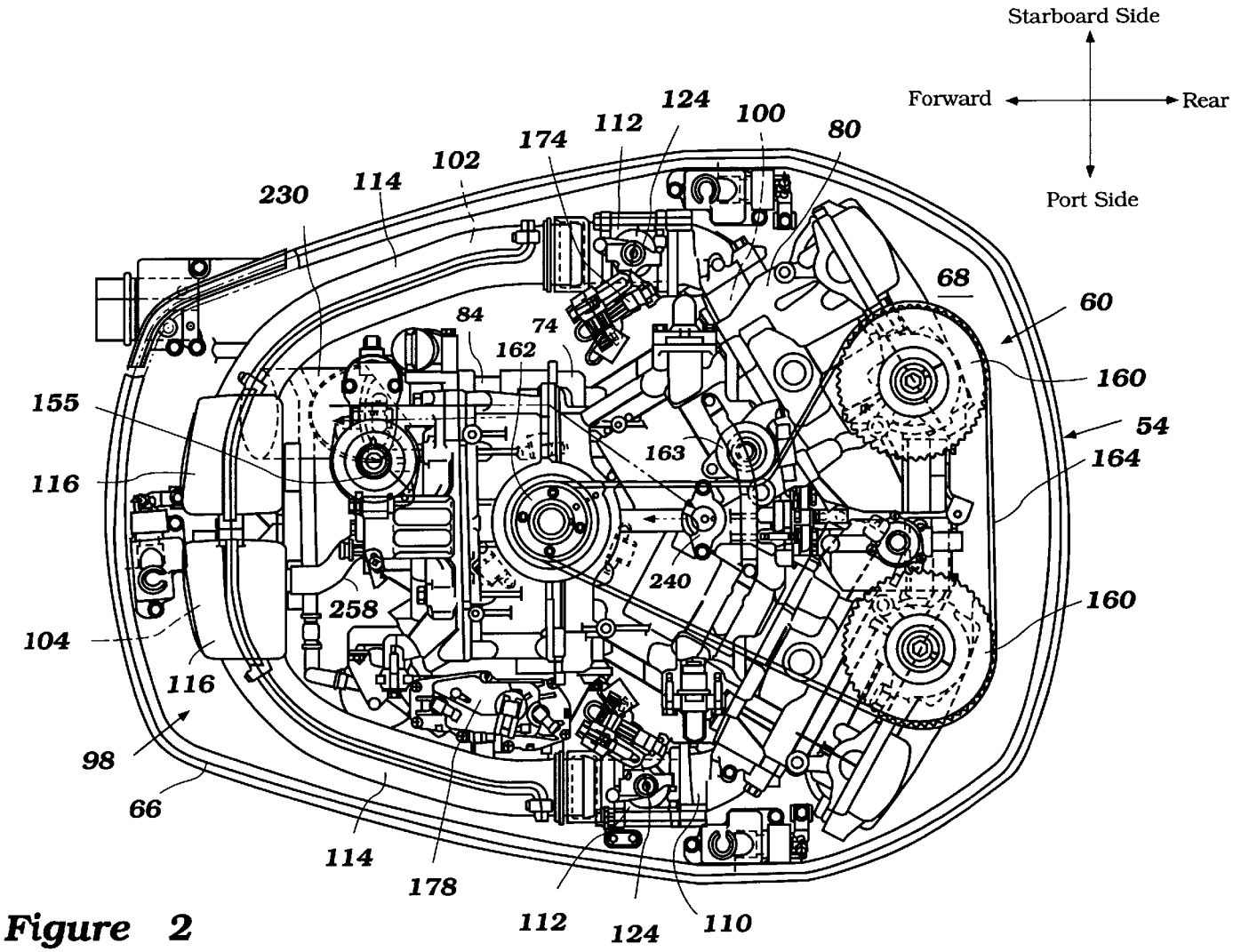
FIG. 2 is a top plan view of a power head of the outboard motor. A top cowling member of the power head is detached to show the engine.

The engine 60 includes an air induction system 98. The air induction system 98 supplies the air existing in the closed cavity 68 of the cowling assembly 62 to the combustion chambers 82. As seen in FIGS. 2 and 3, the air induction system 98 includes intake ports 100, a pair of intake passages 102 and a pair of plenum chambers 104.

Twelve intake ports 100 are provided, six of which are disposed at the bank on the starboard side and another six of which are disposed at the other bank on the port side. That is, one cylinder bore 76 has two intake ports 100. The intake ports 100 are defined in the respective cylinder head members 80 on outer sides of the respective banks. The intake ports 100 are opened and closed by intake valves 106.

Three intake passages 102 extend from the respective intake ports 100 of one of the bank generally along a side surface of the cylinder body 74 and the crankcase assembly 84 on the starboard side, while another three intake passages 102 extend from the intake ports 100 of the other bank along the other side surface of the cylinder body 74 and the crankcase assembly 84 on the port side. When each intake port 100 is opened, the corresponding intake passage 102 communicates with the associated combustion chamber 82.

The air intake passages 102 are actually defined by intake manifolds 110, throttle bodies 112 and intake runners 114, while the plenum chambers 104 are defined by plenum chamber members 116. Each intake manifold 110 is affixed to the cylinder head member 80. In the illustrated embodiment, the intake runners 114 on each bank are unified with one of the plenum chamber members 116 which is positioned nearby to form a pair of intake units. The throttle bodies 112 are interposed between the intake manifolds 110 and the intake runners 114. The respective plenum chambers 104 are thus coupled to the associated intake ports 100 through the intake passages 102 defined in the intake runners 114, the throttle bodies 112 and the intake manifolds 110.

The respective throttle bodies 112 support throttle valves disposed therein for pivotal movement about axes of valve shafts 124 which extend generally vertically. The valve shafts 124 are linked together to form a single valve shaft that passes through the entire throttle bodies 112. The throttle valves are operable by the operator through a suitable throttle cable and a linkage mechanism.

When the operator operates the throttle cable, the linkage mechanism activates the valve shaft 124 to open the throttle valves for adjusting an amount of air passing therethrough. Conversely, when the throttle cable is released, the linkage mechanism moves the valve shaft 124 to close the throttle valves.

The plenum chamber members 116 have air inlet ports 130 opening toward the crankcase assembly 84. The air in the closed cavity 68 of the cowling assembly 60 is introduced into the plenum chambers 104 through the inlet ports 130. A balance pipe (not shown) couples both the plenum chambers 104 together. The plenum chambers 104 function as air intake silencers and air coordinators.

The engine 32 includes an exhaust system 136 that discharges the burnt charges (e.g., exhaust gases) from the combustion chambers 82 to outside the outboard motor 30. Twelve exhaust ports 138 are provided, six of which are disposed at the bank on the starboard side, and another six of which are disposed at the other bank on the port side. That is, one cylinder bore 76 has two exhaust ports 138. The exhaust ports 138 are defined in the respective cylinder head members 80 on the opposite sides of the respective banks relative to the intake ports 100, i.e., inner sides of the banks. The exhaust ports 138 are opened and closed by exhaust valves 140. The respective banks have exhaust passages 140 extending generally vertically and parallel to each other in a space defined between both the banks. The exhaust passages 140 are defined by and between the cylinder body 74 and the exhaust members 142. When the exhaust ports 138 are opened, the combustion chambers 82 communicate with the exhaust passages 140. The exhaust passages 140 communicate with the exhaust passage 72 of the exhaust guide member 70.

Each bank has an intake camshaft 146 and an exhaust camshaft 148 extending generally vertically. Because of the foregoing positions of the intake and exhaust ports 100, 138, both the exhaust camshafts 148 are positioned next to each other, and the respective intake camshafts 146 are spaced apart from each other so as to interpose both the exhaust camshafts 148 therebetween. The respective camshafts 146, 148 extend within camshaft chambers 150 defined by the cylinder head members 80 and camshaft covers 152. The camshafts 146, 148 are journaled by the cylinder head members 80 and are rotatably affixed thereto by camshaft caps.

The intake camshafts 146 activate the intake valves 106, while the exhaust camshafts 148 activate the exhaust valves 140. The respective camshafts 146, 148 have cam lobes 156 to push the intake and exhaust valves 106, 140 at certain timings to open and close the intake and exhaust ports 100, 138, respectively.

As seen in FIG. 2, the crankshaft 88 drives the exhaust camshafts 148. The exhaust camshafts 148 have driven sprockets 160 fitted thereto, while the crankshaft 88 also has a drive sprocket 162 fitted thereto. A guide or idle roller 163 is also provided. A timing chain 164 is wound around the drive and driven sprockets 162, 160 and the guide roller 163. When the crankshaft 88 rotates, the exhaust camshafts 148 also rotate, but at half speed due to the larger size of the driven sprockets 160.

As seen in FIG. 3, the exhaust camshafts 148 drive the intake camshafts 146. The exhaust camshafts 148 have drive sprockets 165, while the intake camshafts 146 have driven sprockets 166. Timing chains 168 are wound around the respective drive and driven sprockets 165, 166 . Chain guide members 170 are provided for guiding the chains 168. With rotation of the exhaust camshafts 148, the intake camshafts 146 also rotate at the same speed as the exhaust camshafts 148.

The driven sprockets 160 of the exhaust camshafts 148 have diameters twice as large as the diameters of the drive sprocket 162 of the crankshaft 88. This is because the intake and exhaust camshafts 146, 148 must rotate in a speed that is half as a rotational speed of the crankshaft 88. The drive sprockets 165 of the exhaust camshafts 148 and the driven sprockets 166 of the intake camshafts 146 are of the same diameter.

In the illustrated embodiment, the engine 60 has a port or manifold fuel injection system, although other conventional fuel supply and charge forming systems such as a direct fuel injection system as carburetors can be applied. The fuel injection system includes six fuel injectors 174 each associated with the respective combustion chamber 82. The fuel injectors 174 have injection nozzles directed toward the respective intake passages 102 adjacent to the intake ports 100. The fuel injectors 174 spray fuel into the intake passages 102 under a control of an ECU (Electronic Control Unit). More specifically, the ECU 176 controls a fuel amount and injection timing of each injection. Fuel rails that are affixed to the throttle bodies 112 support the fuel injectors 174.

The fuel injection system further includes a fuel supply tank that is placed in the hull of the associated watercraft 40 to contain fuel that will be sprayed by the fuel injectors 174. Fuel is drawn from the fuel tank through a fuel supply passage by a low-pressure fuel pump and supplied to a fuel reservoir or fuel vapor separator 178.

As seen in FIG. 2, the vapor separator 178 is generally disposed at a space defined between the port side surface of the crankcase assembly 84 and the intake runners 114. At the end of the supply passage to the vapor separator 178, a float valve is provided that is operated by a float so as to maintain a uniform level of the fuel in the vapor separator 178. A high-pressure fuel pump is internally placed in the vapor separator 178 and pressurizes the fuel that is delivered to the fuel injectors 174 through a fuel delivery passage which includes the fuel rail. The high-pressure fuel pump is an electric pump that is driven by an electric motor and develops a pressure greater than a pressure developed by the low-pressure fuel pump.

A fuel return passage connects a portion of the fuel delivery passage to the vapor separator 178 to return excess fuel thereto. A pressure regulator is positioned in the return passage and limits the pressure that is delivered to the fuel injectors 174 to a preset and fixed magnitude by dumping the fuel back to the vapor separator 178 when the pressure in the fuel rail is greater than the preset magnitude. Because the pressure regulator keeps the pressure at this constant magnitude, the ECU controls the duration of each injection so as to measure the amount of the sprayed fuel.

The engine 60 further includes an ignition or firing system. Three spark plugs preferably are mounted on each cylinder head member 80 so as to expose electrodes to the associated combustion chambers 82. The spark plugs fire air/fuel charges in the combustion chambers 82 at each proper timing. This firing timing is also controlled by the ECU. The air/fuel charge is formed with the air supplied by the air induction system 98 and the fuel sprayed by the fuel injectors 174 of the fuel injection system.

A flywheel assembly 184 is affixed atop the crankshaft 88. The flywheel assembly 184 includes a generator to supply electric power to the firing system, to the ECU and to other electrical components via a battery and/or directly.

The engine 60 further has a water cooling system that provides cooling water to engine portions, for example, the cylinder body 74 and the cylinder head member 80 because they are significantly heated during engine operations. For instance, water jackets 180 (FIG. 3) are formed within the cylinder body 74, the cylinder head member 80 and the crankcase assembly 84. The water is also supplied to the exhaust system 136. Cover members 182, as best seen in FIG. 3, are affixed to the exhaust members 142 to define the water jackets 180 also therebetween. The cooling water is introduced from the body of water surrounding the outboard motor 30 in a manner that is well known. The water is discharged outside of the drive unit 34 through certain drain passages. Before discharged, however, some of the water is released into the driveshaft housing 56 for cooling part of the exhaust system 136 disposed therein. The water thus remains as mist in the driveshaft housing 56 or is splashed by components or members in the driveshaft housing 56.

The lubrication system 32 employed for engine lubrication will be described in great detail shortly.

Additionally, the engine 60 in the illustrated embodiment has, other than the ECU, a number of engine-related devices or. components that are mounted on the engine 60 or provided adjacently to the engine 60. For example, a starter motor 185 is included in those devices. The starter motor 185 is disposed in a space defined by and between the plenum chamber members 116 and the crankcase assembly 84 with some other electrical components. In the illustrated embodiment, for example, a crankshaft angle position sensor 186 (FIG. 4) is also provided atop the cylinder body 74 in the close proximity to a washer 188 affixed to the crankshaft 88. The washer 188 has notches around its outer periphery. The position sensor 186 is a proximity switch that generates signals when the notches approach the position of the sensor. The signals generated by the position sensor 186 are sent to the ECU and are used for various engine controls.

With reference back to FIG. 1, the driveshaft housing 56 depends from the power head 54 and supports a driveshaft 192 that is driven by the crankshaft 88. As seen in FIGS. 4 and 5, the crankshaft 88 has a splined recess 194 at its bottom portion, while the driveshaft 192 has a splined top. The splined top of the driveshaft 192 is fitted into the splined recess 194 of the crankshaft 88 so that the driveshaft 192 is coupled with the crankshaft 88. The driveshaft 192 extends generally vertically through the exhaust guide member 70 and the driveshaft housing 56.

The driveshaft housing 56 also defines internal passages which form portions of the exhaust system 136. In the illustrated embodiment, an exhaust pipe 196 depends from the exhaust guide member 70 and extends downwardly. An upper portion of the exhaust pipe 196 communicates with the exhaust passage 72 defined in the exhaust guide member 70. A lower portion of the exhaust pipe 196 communicates with an exhaust expansion chamber. The expansion chamber has a relatively large capacity so that the exhaust gases expand there to lose energy and silence exhaust noise. An idle exhaust passage branches off from one of the internal passages and opens to the atmosphere above the body of water.

The lower unit 58 depends from the driveshaft housing 56 and supports a propulsion shaft 200 which is driven by the driveshaft 192. The propulsion shaft 200 extends generally horizontally through the lower unit 58. In the illustrated embodiment, the propulsion device supports a propeller 202 that is affixed to an outer end of the propulsion shaft and is driven thereby. The propulsion device, however, can take the form, such as, for example, a dual, a counter-rotating propeller system, a hydrodynamic jet, or like propulsion devices.

A transmission 204 is provided between the driveshaft 192 and the propulsion shaft 200. The transmission 204 couples together the two shafts 192, 200 which lie generally normal to each other (i.e., at a 90° shaft angle) via a bevel gear train or the like. The transmission 204 has a switchover or clutch mechanism to shift rotational directions of the propeller 202 between forward, neutral and reverse. The switchover mechanism is operable by the operator through a shift linkage that includes a shift cam, a shift rod and a shift cable. The shift cable extends toward the watercraft 40 along with the throttle cable.

The lower unit 58 also defines an internal passage that forms a discharge section of the exhaust system 136. An upper portion of this internal passage connects to the expansion chamber in the driveshaft housing 56. At engine speeds above idle, the majority of the exhaust gases are discharged toward the body of water through the internal passage and a hub of the propeller 202. At the idle speed of the engine 60, the exhaust gases are mainly discharged through the idle exhaust passage because the exhaust pressure under this condition is smaller than the backpressure created by the body of water.

With reference still to FIGS. 1 to 5, the lubrication system 32 will now be described. A lubricant reservoir or oil pan 210 depends from the exhaust guide member 70 into the driveshaft housing 56 and contains lubricant (e.g., oil). The lubricant reservoir 210 in this embodiment is generally configured as a doughnut shape. The foregoing exhaust pipe 196 extends through a center hollow of the lubricant reservoir 210. An upper portion of the driveshaft housing 56 surrounds the lubricant reservoir 210. The driveshaft 192 extends in front of the lubricant reservoir 210. A suction pipe 212 is provided in the lubricant reservoir 210 to connect the reservoir 210 to an oil pump unit 214. The suction pipe 212 has a port at almost the bottom position of the lubricant reservoir 210. An oil strainer 216 is provided at the port for removing foreign substances from the lubricant oil.

The oil pump unit 214 is defined at the coupling portion of the driveshaft 192 with the crankshaft 88 and is driven by the crankshaft 88. The lubricant in the lubricant reservoir 210 is drawn by this oil pump unit 214 and is delivered to engine portions that need lubrication. As best seen in FIG. 4, the oil pump has an inlet port 220 and an outlet port 222. The inlet port 220 communicates with the suction pipe 212 through a suction passage 224, while the outlet port 222 communicates with the engine portions through a delivery passage 226. The suction passage 224 is defined in the exhaust guide member 70 and the cylinder body 74, while the delivery passage 226 is defined in the cylinder body 74. The construction of the oil pump unit 214 will be described in great detail shortly.

The engine portions that need lubrication include, for example, crankshaft bearing portions 228 where the bearing blocks 94*a*, 94*b*, 94*c*, 94*d* support the crankshaft 88. As best seen in FIG. 5, an oil filter 230 is detachably affixed to a mount projection 232 formed at a bottom portion of the crankcase cover 84*b* to remove further foreign substances and particles. The delivery passage 226 communicates with the oil filter 230. The oil filter 230 communicates with a supply passage 224 (FIG. 4) and then with a main gallery 236 (FIG. 3) both defined in the cylinder body 74. A closure member 240 (FIG. 2) closes the top portion of the main gallery 236. The lubricant is then supplied to the respective bearing portions through branch passages defined within the bearing blocks 94*a*, 94*b*, 94*c*, 94*d*. After lubricating these engine components, the lubricant falls to the bottom of the crankcase chamber 86 due to gravity.

The engine portions that need lubrication further include portions where the connecting rods 90 are coupled with the crankshaft 88 and where they are coupled with the pistons 78. The pistons 78 furiously reciprocate within the cylinder bores 76 and thus the pistons 78 also need the lubrication. Some of the lubricant is delivered to those portions through drilled passages 244 (FIGS. 4 and 5) in the crankshaft 88 and the connecting rods 90. Inlet ports 246 are opened at certain portions of the crankshaft 88. The lubricant after lubricating these portions also drop to the bottom of the crankcase chamber 86.

The pistons 78 need the lubrication not to seize on surfaces of the cylinder bores 76. One or more through-holes are made at each skirt portion of the piston 78 and hence the lubricant oil can move out to the outer surface of the piston 78 which slides along the surface of the cylinder bore 76. Piston rings are provided on and around the pistons 78 primarily to isolate the combustion chambers 82 from the crankcase chamber 86. At least one piston ring, which is normally placed at the lowermost position, can remove the lubricant from the surface of the cylinder bore 76 to the crankcase chamber 86. The engine portions that need lubrication further include camshaft bearing portions. Lubricant delivery arrangements for the camshaft bearing portions are similar to the arrangement described above.

The lubricant that has dropped onto the bottom of the crankcase chamber 86 returns to the lubricant reservoir 210 through a return passage. The lubricant oil that has returned to the lubricant reservoir 210 is recycled so as to lubricate repeatedly the same engine portions.

Some lubricant, however, hangs in the air of the crankcase chamber 86 as a mist or vapor. This lubricant mist tends not to drop down to the lubricant reservoir 210 because the crankshaft 88 furiously rotates in this chamber 86*a* which causes the mist to quickly swirl about the crankshaft axis within the chamber. The lubricant, however, preferably returns to the lubricant reservoir 210 as soon as possible to be reused.

In the illustrated embodiment, a baffle plate 250 (FIG. 3) is affixed to the crankcase member 84*a* to divide the crankcase chamber 86*a* into a primary chamber 86*a* and a secondary chamber 86*b*, although both the chambers 86*a*, 86*b* communicate with each other through a plurality of slits 252 and spaces defined at both sides of the baffle plate 250. The primary chamber 86*a* has a larger capacity than the secondary chamber 86*b* and the crankshaft 88 is disposed in the primary chamber 86*a*. Also, the baffle plate 250 bulges out toward the secondary chamber 86*b*, as seen in FIG. 3.

The baffle plate 250 is advantageous for returning the lubricant quickly to the reservoir 200. That is, the lubricant mist can move to the secondary chamber 86*b* through the plurality of slits 252 provided at in the plate 250 and spaces defined at both sides thereof. Once it has moved to the secondary chamber 86*b*, the mist soon condenses by adhering a surface of the baffle plate 250 and an inner surface of the crankcase cover 84*b* because the rotational movement of the crankshaft 88 does not significantly influence the mist in this secondary chamber 86*b*. The liquid lubricant then falls to the lubricant reservoir 200 along the surfaces of the baffle plate 250 and the crankcase cover 84*b*.

The lubricant mist in the primary chamber 86*a* includes blow-by gases. The blowby gases comprise unburnt charges and a small amount of exhaust gases that have been blown from the combustion chambers 82, past the piston rings and into the crankcase chamber. Although the combustion chambers 82 are isolated by the piston rings as noted above, those gases can leak to the crankcase chamber 86 because of huge expansion pressure generated in the combustion chambers 82.

In order to remove the blow-by gases and oil vapors that still remain in the secondary chamber 86*b*, a ventilation system is provided in the engine 60 of this embodiment. The ventilation system comprises a breather chamber or oil separator 256 and a breather pipe 258.

he breather chamber 256 is defined by an inner surface of the crankcase cover 84*b*, a rampart (i.e., a structure with walls that surround a space) extending from the inner surface of the crankcase cover 84*b* and a lid plate 260 affixed to the rampart. A plurality of baffle projections 262 also extends from the inner surface of the crankcase cover 84*b* so that a labyrinth structure is formed within the breather chamber 256. The baffle projections 262 are generally directed downwardly. An inlet port of the breather chamber 256 opens downwardly at its bottom portion, while an outlet port thereof, which is a through-hole, opens atop the breather chamber 256 and also atop of the crankcase cover 84*b*.

The breather pipe 258 couples the breather chamber 256 with one or both of the plenum chambers 104. In the illustrated embodiment, the plenum chamber member 116 which is disposed on the port side has an inlet port, and the breather pipe 258 connects the outlet port of the breather chamber 256 to the inlet port of this plenum chamber member 116.

The oil vapors or mist including the blow-by gases are introduced into the breather chamber 256 through the inlet port because the air in the plenum chamber 104 is drawn to the combustion chambers 82 during engine operations to depressurize the breather chamber 256. The oil vapors are directed to the outlet port through the labyrinth structure. Because the baffle projections 262 prevent the oil vapors from moving smoothly, the vapors condense and thus are separated from gases. The condensed oil then drops down to the lubricant reservoir 210 and only the gases flow to the outlet port. The gases then move to the plenum chamber 104 through the breather pipe 258 and further to the combustion chambers 82 through the intake passages 102. The gases that have reached the combustion chambers 82 are burned therein with the air/fuel charges that have been simultaneously supplied to the combustion chambers 82.

Figure 7:
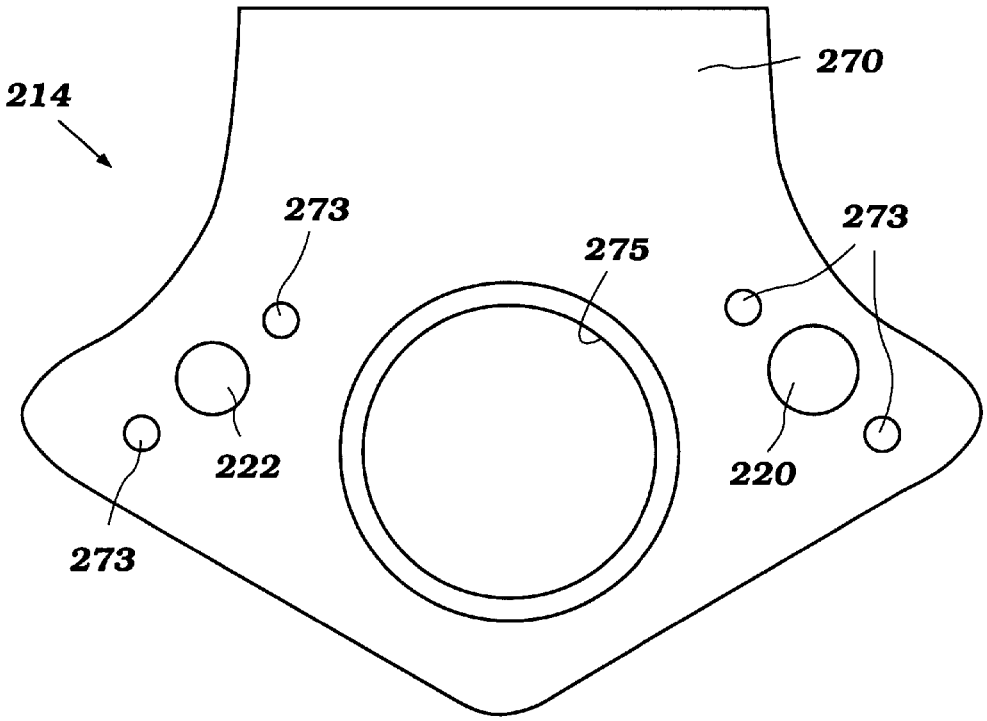
FIG. 7 is a schematic top plan view of the oil pump unit.
Figure 8:
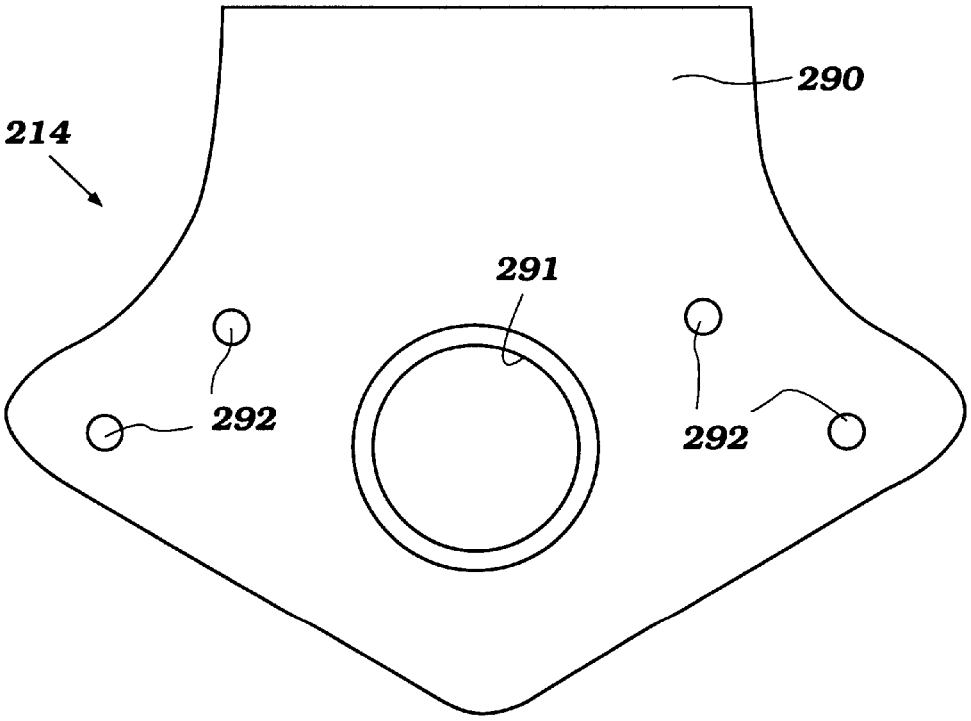
FIG. 8 is a schematic bottom plan view of the oil pump unit.

With reference still to FIGS. 4 and 5 and additionally to FIGS. 6 to 8, the construction of the oil pump unit 214 will now be described. The oil pump unit 214 is defined at the bottom portion 264 of the cylinder body 74 and the crankcase member 84*a* where the driveshaft 192 is coupled with the crankshaft 88. The water mist hangs around the coupling portion in the air because the water cooling system drains the water to inner spaces of the driveshaft housing 56 after cooling the engine portions. In order to protect the coupling portion from the water mist or splashed water coming from the driveshaft housing 56, and additionally to inhibit the lubricant oil in the oil pump unit 214 from entering the coupling portion, the oil pump unit 214 in this embodiment has an improved construction.

In the illustrated embodiment, the oil pump unit 214 defines a rotary or trochoid pump. This type of pump, however, merely exemplifies a type of pump that can be used for the lubrication system. Other types of pumps such as, for example, a gear pump, can also be used.

An upper housing member 270 is affixed to the bottom of the cylinder body 74 and the crankcase member 84*a* by bolts 272. As seen in FIG. 7, bolt holes 273 for the bolts 272 are provided both sides of the inlet port 220 and the outlet port 222. The upper housing member 270 has a cylindrical portion 274 fitted into a recessed portion defined by the cylinder body 74 and the crankcase member 84*a*. The cylindrical portion 274 defines an opening 275 (FIG. 7) through which the crankshaft 88 extends. An upper oil seal member 276 (FIG. 4) is provided between an outer surface of the crankshaft 88 and an inner surface of the upper housing member 270 for preventing the lubricant in the oil pump unit 214 from leaking out. The inlet port 220 and the outlet port 222 are formed at the upper housing member 270. The upper housing member 270 preferably is made of metal or plastic.

Figure 6:
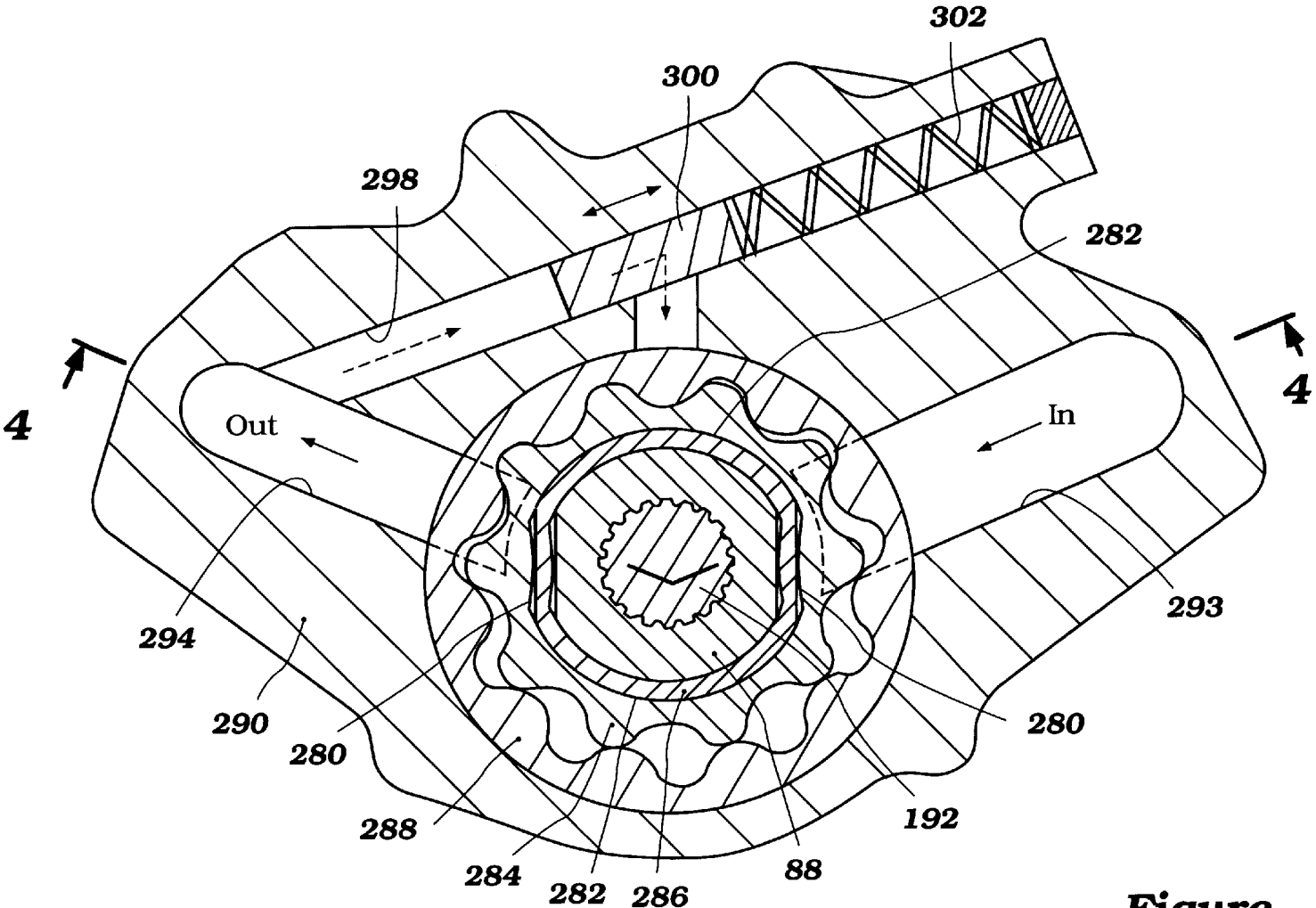
FIG. 6 is an enlarged, cross-sectional view of the oil pump unit taken along the line 6—6 of FIG. 4.

As seen in FIGS. 5 and 6, the crankshaft 88 is cut away to define two flat surfaces 280 extend in parallel to each other. The other surfaces 282 hold arc configurations. An inner rotor 284, which has a recess that is conversely configured relative to the outer configuration of the crankshaft 88, is fitted onto the crankshaft 88 via a drive collar or bush member 286. An outer rotor 288 then meshes with the inner rotor 284. The inner and outer rotors 284, 288 together form a pumping assembly.

It should be noted that the drive collar 286 is dispensable. In this variation, the inner rotor 284 is directly coupled with the crankshaft 88.

A lower housing member 290 is affixed to the lower surface of the upper housing member 270 so as to define a pump cavity with the upper housing member 270 in which the inner and outer rotors 284, 288 are disposed. In the illustrated embodiment, the lower housing member 290 is defined by a single piece. As seen in FIG. 8, the lower housing member 290 has an opening 291 through which both the crankshaft 88 and the driveshaft 192 extend. The bolts 272 are commonly used in this embodiment for fixing the lower housing member 290 to the upper housing member 270. Bolt holes 292 are provided at portions corresponding to the portions where the associated bolt holes 273 of the upper housing member 270 are provided. An inlet passage 293 and an outlet passage 294 are defined between the upper housing member 270 and the lower housing member 290. The inlet passage 293 communicates with the inlet port 220, while the outlet passage 294 communicates with the outlet port 222. The lower housing member 290 preferably is made of metal or plastic.

Additionally, as best seen in FIG. 6, a relief passage 298 preferably connects the outlet passage 294 and a space defined between the inner and outer rotors 284, 288. A slide member 300 is provided within the relief passage 294 so as to normally close the relief passage 298. A coil spring 302 urges the slide member 300 to close the passage 298. In the event oil pressure in the outlet passage 294 becomes abnormally high, the pressure on the slide member 300 overcomes the urging force of the spring 302 and moves the slide member 300 to open the relief passage 298. The excess oil thus returns back to the space defined between the inner and outer rotors 284, 288.

A lower oil seal member 306 (FIG. 4) is provided between another outer surface of the crankshaft 88 and an inner surface of the lower housing member 290. A water seal member 308 is further provided between a surface of the driveshaft 192 and another inner surface of the lower housing member 290. The lower oil seal member 306 inhibits the lubricant oil in the oil pump unit 214 from leaking out the bottom of the oil pump unit 214, while the water seal member 308 inhibits water or water mist from contacting the coupling portion between the shafts 88, 192.

In the illustrated embodiment, the crankshaft 88 actually defines three sections having different diameters. An upper section is larger than a middle section, and the middle section is larger than a lower section. The upper oil seal member 276 is positioned at the upper section. The inner and outer rotors 284, 288 are positioned at the middle section. The lower oil seal member 306 is positioned at the lower section.

With rotation of the crankshaft 88, the inner rotor 284 is driven by the crankshaft 88 via the drive collar 286. Because the outer rotor 288 meshes with the inner rotor 284, the outer rotor 288 also rotates with the inner rotor 284. The space, which is defined between the inner and outer rotors 284, 288, communicates with the inlet passage 292 and the outlet passage 294, and changes its volume with the rotation of the inner and outer rotors 284, 286. The oil in the space is thus suctioned into the space from the inlet passage 292 and then pushed out to the outlet passage 294.

Because the lower oil seal member 306 inhibits the oil in the housing members 270, 290 from leaking, the oil cannot accumulate at the coupling portion of the driveshaft 192 with the crankshaft 88 and hence will not deteriorate.

In addition, the lower oil seal member 306 faces the outer surface of the crankshaft 88 without having something such as a sleeve lying therebetween. This outer surface of the crankshaft 88 thus can be simultaneously machined with other portions that need to be machined. The construction thus eliminates the manufacturing step that has been required with prior constructions.

Of course, the foregoing description is that of a preferred embodiment of the present invention, and various changes and modifications may be made without departing from the spirit and scope of the invention, as defined by the appended claims.

What is claimed is:

1. An engine and driveshaft arrangement comprising an internal combustion engine having a crankshaft extending generally vertically, a driveshaft also extending generally vertically and being driven by the crankshaft, and a lubrication system comprising a pumping assembly driven by the crankshaft, a pump housing arranged to contain the pumping assembly, the pump housing defining an inlet port through which lubricant enters the pump housing and an outlet port through which the lubricant is discharged from the pump housing, the pump housing including a lower housing section and an upper housing section, the lower housing section defining a recessed portion, the upper housing section covering the recessed portion to form a pump cavity with the lower housing section, the pumping assembly being disposed within the recessed portion, the lower housing section further defining first, second and third inner surface portions that together form an opening, both the crankshaft and the driveshaft extending through the opening and being coupled with each other at least partially within the pump housing, a first seal member disposed around the crankshaft to seal a first location between an outer surface portion of the crankshaft and the first inner surface portion of the lower housing section, and a second seal member disposed around the driveshaft to seal a second location between a first outer surface portion of the driveshaft and the second inner surface portion of the lower housing section, the third inner surface portion of the lower housing facing a second outer surface portion of the driveshaft positioned lower than the first outer portion of the driveshaft, and the lower housing section being formed with a single member that solely defines the recessed portion and the first, second and third inner surface portions.

2. The engine and driveshaft arrangement as set forth in claim 1, wherein the upper housing section defines an inner surface portion that forms a second opening, the crankshaft extends through the second opening, the lubrication system additionally comprises a third seal member disposed around the crankshaft for sealing a third location between a second outer surface portion of the crankshaft and the inner surface portion of the upper housing section.

3. The engine and driveshaft arrangement as set forth in claim 1, wherein at least one of the inlet and outlet ports is defined at the upper housing section.

4. The engine and driveshaft arrangement as set forth in claim 3, wherein the lubrication system additionally comprising at least one fastener to connect the lower and upper housing sections with each other, and the fastener is positioned adjacent to the inlet or outlet port.

5. The engine and driveshaft arrangement as set forth in claim 3, wherein the lubrication system additionally comprising at least two fasteners to connect the lower and upper housing sections with each other, and the fasteners are positioned adjacent to the inlet or outlet port and opposite to each other relative the inlet or outlet port.

6. The engine and driveshaft arrangement as set forth in claim 1, wherein the pumping assembly includes an inner rotor driven by the crankshaft and an outer rotor driven by the inner rotor.

7. The engine and driveshaft arrangement as set forth in claim 1, wherein the crankshaft has first and second outer surface portions having different diameters from each other, the first seal member is disposed at the first outer surface portion of the crankshaft, and the pumping assembly is disposed at the second outer surface portion of the crankshaft.

8. The engine and driveshaft arrangement as set forth in claim 7, wherein the first outer surface portion of the crankshaft has a diameter smaller than a diameter of the second outer surface portion of the crankshaft.

9. The engine and driveshaft arrangement as set forth in claim 1, wherein the crankshaft has a splined recess at a bottom thereof, the driveshaft has a splined top, and the splined top is fitted into the splined recess.

10. The engine and driveshaft arrangement as set forth in claim 1, wherein the engine operates on a four-cycle combustion principle.

11. The engine and driveshaft arrangement as set forth in claim 1, wherein both the inlet and outlet ports are defined at the upper housing section.

12. An engine and driveshaft arrangement comprising an internal combustion engine having a crankshaft extending generally vertically, a driveshaft also extending generally vertically and being driven by the crankshaft, and a lubrication system comprising a pumping assembly driven by the crankshaft, the pumping assembly including an intermediate member driven by the crankshaft, an inner rotor driven by the intermediate member and an outer rotor driven by the inner rotor, a pump housing arranged to contain the pumping assembly, the pump housing defining an inlet port through which lubricant enters the pump housing and an outlet port through which the lubricant is discharged from the pump housing, both the crankshaft and the driveshaft extending through an opening defined at the pump housing and being coupled with each other at least partially within the pump housing, a first seal member disposed around the crankshaft to seal a first location between an outer surface section of the crankshaft and a first inner surface section of the pump housing that defines at least a portion of the opening, and a second seal member disposed around the driveshaft to seal a second location between an outer surface of the driveshaft and a second inner surface section of the pump housing that also defines at least a portion of the opening.

13. An outboard motor comprising a driveshaft extending generally vertically and an internal combustion engine including an output shaft extending generally vertically, a lubricant pump unit comprising a lower housing section defining a recessed portion, an upper housing section coupled with the lower housing section to cover the recessed portion, the lower housing section and the upper housing section together forming an internal cavity to contain lubricant, the driveshaft and the output shaft including end portions that are coupled with each other in the internal cavity, a pumping assembly disposed within the recessed portion of the lower housing section and driven by the output shaft, the lower housing section further defining first, second and third inner surface portions, a first seal member interposed between an outer surface portion of the output shaft and the first inner surface portion of the lower housing section to inhibit lubricant from entering a location about the coupled end portions within the recessed portion, and a second seal member interposed between a first outer surface portion of the driveshaft and the second inner surface portion of the lower housing section to inhibit water from entering the location about the coupled end portions, the third inner surface portion of the lower housing facing a second outer surface portion of the driveshaft positioned lower than the first outer surface portion of the driveshaft, and the lower housing section being formed with a single member that solely defines the recessed portion and the first, second and third inner surface portions.

14. The outboard motor as set forth in claim 13, wherein the upper housing section of the lubricant pump unit defines an inlet port through which the lubricant is drawn.

15. The outboard motor as set forth in claim 14, wherein the upper housing section of the lubricant pump unit additionally defines an outlet port through which the lubricant is discharged.

16. The outboard motor as set forth in claim 13, wherein the upper housing section of the lubricant pump unit defines an outlet port through which the lubricant is discharged.

17. The outboard motor as set forth in claim 13, wherein the pumping assembly includes an inner rotor driven by the output shaft and an outer rotor driven by the inner rotor.

18. The outboard motor as set forth in claim 17, wherein the pumping assembly further includes an intermediate member driven by the output shaft, and the inner rotor is driven by the intermediate member.

19. The outboard motor as set forth in claim 13, wherein the upper housing portion defines an inner surface portion, the lubricant pump unit additionally comprises a third seal member interposed between the output shaft and the inner surface portion of the upper housing section to inhibit the lubricant from leaking out from the internal cavity.

20. The outboard motor as set forth in claim 19, wherein the output shaft has first and second outer surface portions having different diameters from each other, the third seal member is disposed at the first outer surface portion of the output shaft, and the pumping assembly is disposed at the second outer surface portion of the output shaft.

21. The outboard motor as set forth in claim 20, wherein the first outer surface portion of the output shaft has a diameter greater than a diameter of the second outer surface portion of the output shaft.

* * * * *